US009114958B1

(12) United States Patent
DiSpazio

(10) Patent No.: US 9,114,958 B1
(45) Date of Patent: Aug. 25, 2015

(54) REMOTE RELEASE HOOK AND USE METHODS

(71) Applicant: Bull Bag, LLC, Branford, CT (US)

(72) Inventor: Paul G. DiSpazio, Guilford, CT (US)

(73) Assignee: Bull Bag, LLC, Branford, CT (US)

( * ) Notice: Subject to any disclaimer, the term of this patent is extended or adjusted under 35 U.S.C. 154(b) by 0 days.

(21) Appl. No.: 14/170,612

(22) Filed: Feb. 1, 2014

Related U.S. Application Data

(63) Continuation-in-part of application No. 14/151,338, filed on Jan. 9, 2014.

(60) Provisional application No. 61/750,747, filed on Jan. 9, 2013, provisional application No. 61/759,734, filed on Feb. 1, 2013.

(51) Int. Cl.
*B66C 1/34* (2006.01)

(52) U.S. Cl.
CPC ..... *B66C 1/34* (2013.01)

(58) Field of Classification Search
USPC ..... 294/82.3, 82.31, 82.26, 82.33, 68.3, 294/68.2, 68.26, 68.1, 74, 75, 77; 383/24, 383/16, 67
See application file for complete search history.

(56) References Cited

U.S. PATENT DOCUMENTS

| | | | | |
|---|---|---|---|---|
| 3,578,373 | A * | 5/1971 | Metz | 294/82.3 |
| 4,073,531 | A * | 2/1978 | Androski | 294/82.3 |
| 4,174,132 | A * | 11/1979 | Crook, Jr. | 294/82.3 |
| 4,416,480 | A * | 11/1983 | Moody | 294/82.34 |
| 4,569,548 | A * | 2/1986 | Vaders | 294/82.14 |
| 4,678,219 | A * | 7/1987 | Smith et al. | 294/82.33 |
| 5,108,196 | A | 4/1992 | Hughes | |
| 5,178,427 | A * | 1/1993 | Jorritsma | 294/82.36 |
| 5,288,037 | A * | 2/1994 | Derrien | 294/82.3 |
| 5,687,931 | A * | 11/1997 | Hogan | 294/82.33 |
| 5,695,286 | A | 12/1997 | Williamson et al. | |
| 6,739,753 | B2 | 5/2004 | Richardson, Jr. et al. | |
| 7,380,849 | B2 | 6/2008 | Mongan | |
| 7,427,160 | B2 | 9/2008 | Richardson, Jr. et al. | |
| 7,500,786 | B2 | 3/2009 | Richardson, Jr. et al. | |
| 2001/0000464 | A1 | 4/2001 | Beale | |
| 2004/0151404 | A1 | 8/2004 | Richardson, Jr. et al. | |
| 2006/0110074 | A1 | 5/2006 | Richardson, Jr. et al. | |

FOREIGN PATENT DOCUMENTS

WO 2007/108833 A2 9/2007

OTHER PUBLICATIONS

US Office Action for U.S. Appl. No. 14/151,338, dated Sep. 10, 2014.

* cited by examiner

*Primary Examiner* — Paul T Chin
(74) *Attorney, Agent, or Firm* — Bachman & LaPointe, P.C.

(57) ABSTRACT

A remote release hook unit for carrying and releasing a suspended load comprises a body; a swivel for suspending the body; a hook pivotally mounted to the body for articulation between first and second orientations; an electric motor; a battery for powering the electric motor; a controller for receiving control signals and controlling the electric motor; an actuator coupled to the electric motor to be driven by the electric motor; a linkage coupling the actuator to the hook for driving the hook from the first orientation to the second orientation to release a suspended load from the hook; and a shackle held by the body.

20 Claims, 9 Drawing Sheets

REMOTE RELEASE HOOK AND USE METHODS

CROSS-REFERENCE TO RELATED APPLICATIONS

This is a continuation-in-part of U.S. patent application Ser. No. 14/151,338, filed Jan. 9, 2014, and entitled "Waste Bag Use Methods and Apparatus" and benefit is claimed of U.S. Patent Application Ser. No. 61/750,747, filed Jan. 9, 2013, and entitled "Waste Bag Use Methods" and U.S. Patent Application Ser. No. 61/759,734, filed Feb. 1, 2013, and entitled "Waste Bag Use Methods and Apparatus" the disclosures of which are incorporated by reference herein in their entireties as if set forth at length.

BACKGROUND OF THE INVENTION

The disclosure relates to releasable hooks and to large waste bags or dumpster bags.

Several forms of dumpster bags have been sold commercially. One example is in International Application No. WO2007/108833A2, entitled "Bulk Material Handling System and Apparatus, published Sep. 27, 2007, the disclosure of which is incorporated by reference herein in its entirety as if set forth at length. An example of such a bag is seen in FIG. 3. As is discussed below, to hold its open form, this bag includes PVC pipe rim stays and sewn-in corner stay panels. Another bag has a generally rectangular planform wherein right angle corners are replaced by flat panels forming a near-rectangular octagon. Another bag is shown in U.S. Patent Application Ser. No. 61/745,938, filed Dec. 26, 2012, and entitled "Waste Bag and Assembly Methods" and U.S. patent application Ser. No. 14/141,267, filed Dec. 26, 2013, and entitled "Waste Bag and Assembly Methods", the disclosures of which are incorporated by reference herein in their entireties as if set forth at length.

Each of these exemplary bags has eight lifting/carry/securing/dumping loops: four top; and four bottom at or near the respective corners of the rectangular footprint. Typically, the upper four loops may be simultaneously used to lift whereas the lower four are dedicated to tie-down securing and dumping. For example, the upper four loops may be hooked to a hoist to lift a full bag into a metal dumpster or to another dump location. The hoist may be disconnected from those four and connected to an adjacent pair of the lower loops. The hoist may then use those two lower loops to invert and dump the bag contents.

Separately, a variety of remote release hooks are available such as from The Caldwell Group, Inc., Rockford, Ill. and Securalift AS, Stavanger, Norway (see, e.g., U.S. Pat. No. 7,380,849).

SUMMARY OF THE INVENTION

According to one aspect of the disclosure, a remote release hook unit for carrying and releasing a suspended load comprises a body; a swivel for suspending the body; a hook pivotally mounted to the body for articulation between first and second orientations; an electric motor; a battery for powering the electric motor; a controller for receiving control signals and controlling the electric motor; an actuator coupled to the electric motor to be driven by the electric motor; a linkage coupling the actuator to the hook for driving the hook from the first orientation to the second orientation to release a suspended load from the hook; and a shackle held by the body.

A further embodiment may additionally and/or alternatively include the actuator comprising an extensible and contractible member and the linkage including: a first lever having a first pivot fixed relative to the body; a second pivot coupled to the extensible and contractible member; and a third pivot coupled to the hook.

A further embodiment may additionally and/or alternatively include the linkage being a link coupling the third pivot to the hook.

A further embodiment may additionally and/or alternatively include the link being coupled to the hook at a fourth pivot.

A further embodiment may additionally and/or alternatively include the link being coupled to the hook at a fourth pivot at a lever portion of the hook opposite from a J-end of the hook with the hook pivot intervening.

A further embodiment may additionally and/or alternatively include a clasp biased toward a first condition blocking the opening of the hook to prevent movement of a suspended load off the hook and retractable from the first condition toward an interior of the hook to permit said movement of a suspended load off the hook.

A further embodiment may additionally and/or alternatively include a clasp drivable from a blocking condition to an unblocking condition by said linkage driving the hook from the first orientation to the second orientation.

Another aspect involves a method for using the hook unit, the method comprising: driving the actuator by the electric motor so as to drive the hook via the linkage from the first orientation to the second orientation to release a suspended load from the hook.

A further embodiment may additionally and/or alternatively include after the release, the load is still coupled to the shackle.

A further embodiment may additionally and/or alternatively include the driving of the hook causes the shackle to push the load off the hook to release the load.

A further embodiment may additionally and/or alternatively include: the hook unit further comprises a clasp biased toward a first condition blocking the opening of the hook to prevent movement of a suspended load off the hook; and the driving of the hook causes the clasp to retract from the first condition toward an interior of the hook to permit said movement of a suspended load off the hook.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
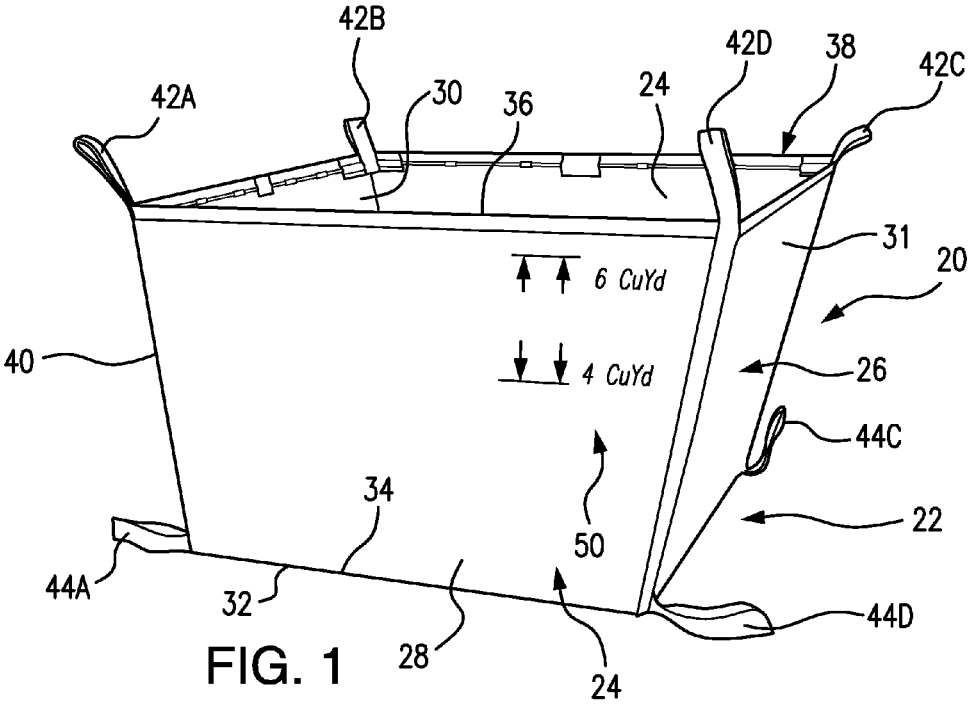
FIG. 1 is a view of an open top, generally right parallelepiped, dumpster bag having carry straps at all four upper corners and dump straps at all four lower corners.

FIG. 1 shows a dumpster bag. The bag is generally characterized by a polymer fabric (e.g., a polyethylene/polypropylene hybrid) body 22 having a generally rectangular planform with a rectangular base or bottom 24 and a sidewall structure 20 circumscribing the base or bottom and comprising four respective generally rectangular sidewalls 28, 29, 30, 31. The sidewalls each extend from a lower edge 32 at a corresponding peripheral edge 34 of the base to an upper edge 36 forming a rim 38 of the bag. Adjacent sidewalls meet at a junction or corner 40. Straps/loops (e.g., for lifting, dumping, tie-down or the like), gussets and other reinforcements, and other features may be of the type generally found in prior art bags or yet developed.

An exemplary nominal 6 cubic yard bag is 77"W×77"L×45"H. The interior and/or exterior may bear fill level indicia 50 (e.g., lines and/or arrows and numbers (e.g., 2 cubic yards and 4 cubic yards in addition to a 6 cubic yard maximum)), allowing one bag size to be used in lieu of a series of sizes.

To hold the bag upright and open, in an assembled condition the bag includes stays (corner stays) 60 (FIG. 2) extending generally vertically along the corner junctions and stays (rim stays) 62 extending generally horizontally adjacent the upper edges of the four sidewalls. The exemplary corner stays are polymeric tube assemblies (e.g., PVC tube). Depending upon bag size, an exemplary corner stay may have a height of between about 0.5 and 2.0 meter (more particularly, 0.7-1.5 meter) and generally nearly bag height.

Figure 2:
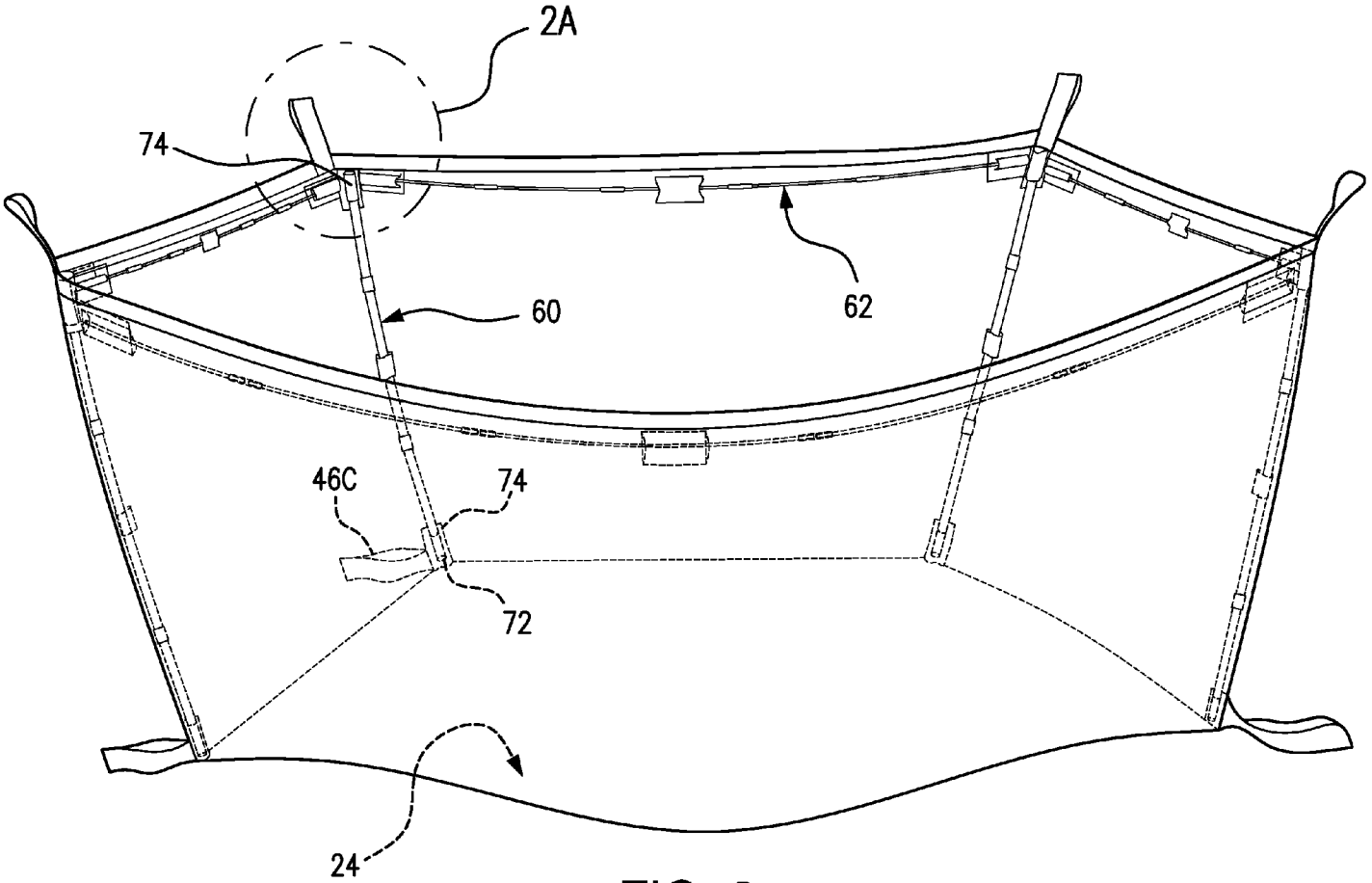
FIG. 2 is an interior view of an upper rim portion of the bag showing full width of one of the four sidewalls.
Figure 2A:
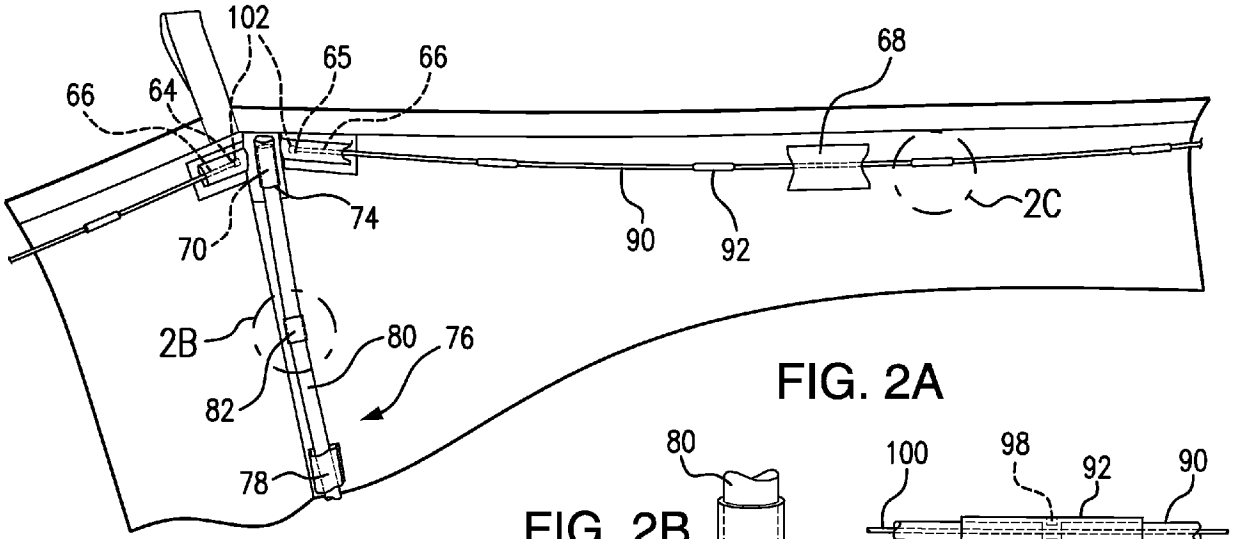
FIG. 2A is an enlarged interior corner view of the bag of FIG. 2.
Figure 2C:
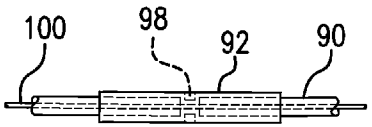
FIG. 2C is an enlarged view of a rim stay joint of the bag of FIG. 2.
Figure 2B:
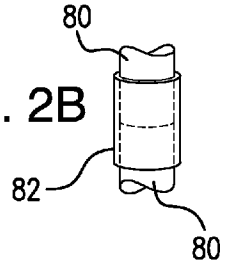
FIG. 2B is an enlarged view of a corner stay joint of the bag of FIG. 2.
Figure 3A:
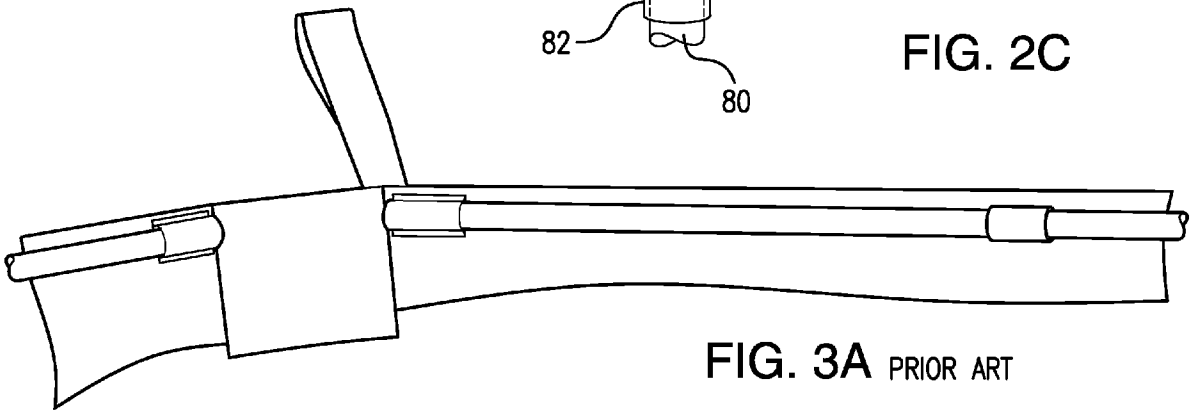
FIG. 3A PRIOR ART
FIG. 3A is an enlarged interior view of the bag of FIG. 3.

FIG. 2 shows each rim stay 62 secured on the interior near the rim 38 of the bag with ends 64, 65 of the rim stay received in sewn-in fabric pockets 66 near the corners adjoining the adjacent walls, an intermediate portion of the rim stay passing through a sewn-in loop 68 (e.g., woven strapping or a similar material to the main portion of the bag) to secure it in place. The corner stays 60 are also shown extending vertically along junctions 40 between the adjacent side panels and similarly between upper and lower end portions 70, 72 accommodated in opposed pockets 74 and an intermediate portion 76 passing through a loop 78.

Figure 3:
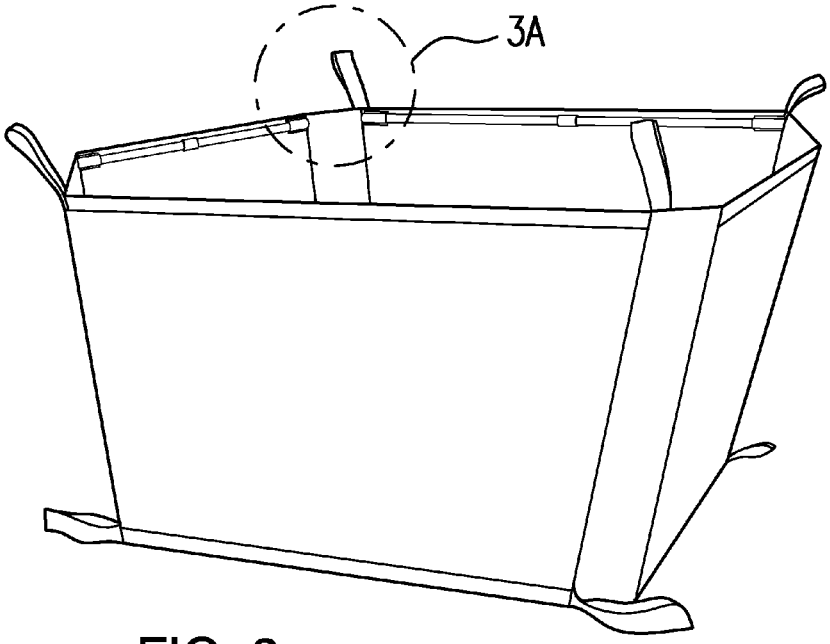
FIG. 3 PRIOR ART
FIG. 3 is a view of a prior art bag comprising sewn-in corner panels and removable pipe rim stays.

If the bag is to be shipped or stored in a folded condition along with the stays, the planform dimensions of the folded bag may be less than the length of the corner says. Accordingly, the exemplary corner stays may be broken down into shorter lengths. In a simple example, this is done by forming each of the corner stays as a plurality of segments of plastic pipe 80 which may be assembled end-to-end. For example, it may be formed in an exemplary two-four segments, more particularly, three. For each segment-to-segment joint, one of the segments may be pre-fitted with an end collar 82 dimensioned to receive the mating end of the next segment. The collar 82 may be a standard pipe fitting or merely a larger pipe whose inner diameter (ID) is sufficient to accommodate the outer diameter (OD) of the segments 80. The collar may be secured to its associated segment by solvent or adhesive bonding or other means. These are similar to the rim stays of the FIG. 3 prior art bag.

For the rim stays 62, it is similarly desirable that they be shortenable for storage and transport. Exemplary rim stays are in the 1.0-4.0 or 1.0-3.0 meter range when assembled, more particularly, 1.5-2.5 meter (and generally about a couple of inches shorter than the associated wall dimension to provide room for the corner stays. The exemplary rim stays are formed by bungee pole (shock pole) assemblies as are used in some tents. Each such bungee pole assembly comprises a series of tubular segments 90 which may be secured end-to-end via fittings 92. For example, exemplary tubular segments are formed of fiberglass or other composite and, for each joint between segments, a tubular metallic fitting (ferrule) 92 is secured to one of the associated segments (e.g., via adhesive or crimping or via a central crimp 98 to hold the ferrule at the junction) to, in turn, receive the associated end of the other associated segment. An elastic member (shock cord) 100 extends through the fitting to draw the two segments together. In one example, a single elastic member extends the entire rim stay length and terminal ends of the terminal segments are covered with resilient elastomeric (e.g., rubber or plastic) caps 102 to avoid cutting the pocket receiving them. Each exemplary rim stay is formed in five segments (more broadly, 3-8 or 4-6). Exemplary tubular segment 90 outer diameter (OD) is less than 1 cm (e.g., nominal 0.25 inch outer diameter or, more broadly, 5-9 mm) From the assembled condition, the bungee pole stays may be extended at the joints to separate one segment end from the adjacent ferrule 92 whereupon it may be folded at the exposed cord. Assembly may be via the reverse, simply straightening and then letting the cord tension seat the segments in the ferrules.

Use of bungee poles for rim stays may have one or more of several advantages relative to using PVC tube assemblies. Greater physical flexibility of the bungee stays may account for several possible advantages. One such advantage is increased robustness. Another possible advantage is that the ability to flex the stay during installation allows the stay to be installed under compression (e.g., flexed in order to engage end pockets). This may allow such bungee stays to better hold the bag fully open than would other stays. Other advantages are that the bungee stays will be even more compact than pipe stays for shipping.

Such bag or the prior art bag may be used via a lift and dump process. An exemplary hoist in the form of a vehicle-mounted crane is used. At the end 200 of its cable 202, the hoist has a hook assembly 204. The exemplary assembly includes a fixed main hook 206 and a remotely releasable hook 208. In this example, a ring or shackle 210 of the remotely releasable hook is suspended from the fixed hook. Other configurations are possible; however, the important feature is having a releasable hook while some other connection is not releasable or does not have to be released.

A plurality of straps is used in the lifting and dumping operation. In this example, there is a pair of dumping straps 230A, 230B and a pair of lifting straps 240A, 240B. Respective first ends of the dumping straps are formed by loops 232A, 232B. Respective second ends of the dumping straps include loops 234A, 234B that, in turn, bear hooks 236A, 236B. The lifting straps have first ends formed by loops 242A, 242B and second ends formed by loops 244A, 244B. The exemplary dumping straps bear hooks at one of their opposite ends whereas each exemplary lifting strap bears only loops. As is discussed further below, other strap configurations are possible including use of a single dumping strap and/or single lifting strap or other combinations.

For an arbitrarily chosen frame of convenient reference, one of the four sides of the bag will be referred to as the rear of the bag, the opposite side being the front, and the other two sides being left and right sides as judged from the perspective of the bag rather than from an observer facing the bag. In this example, the lifting will be from the rear to dump from the front. The dumping strap(s) is (are) used to connect the bag to the hoist for dumping. In this example, the hooks (or carabiners) 236A, 236B are used to connect to loops of the bag whereas the opposite end loops 232A, 232B are connected to the hook assembly (more particularly, to a non-releasing portion of the hook assembly such as the main hook 206 or the ring/shackle of the releasable hook 208). In an alternative embodiment with a single lifting strap, the strap body may be captured by the main hook or the ring/shackle of the releasable hook (or other connection that remains despite releasing of the releasable hook) with the ends connecting to the lower bag loops.

Figure 4:
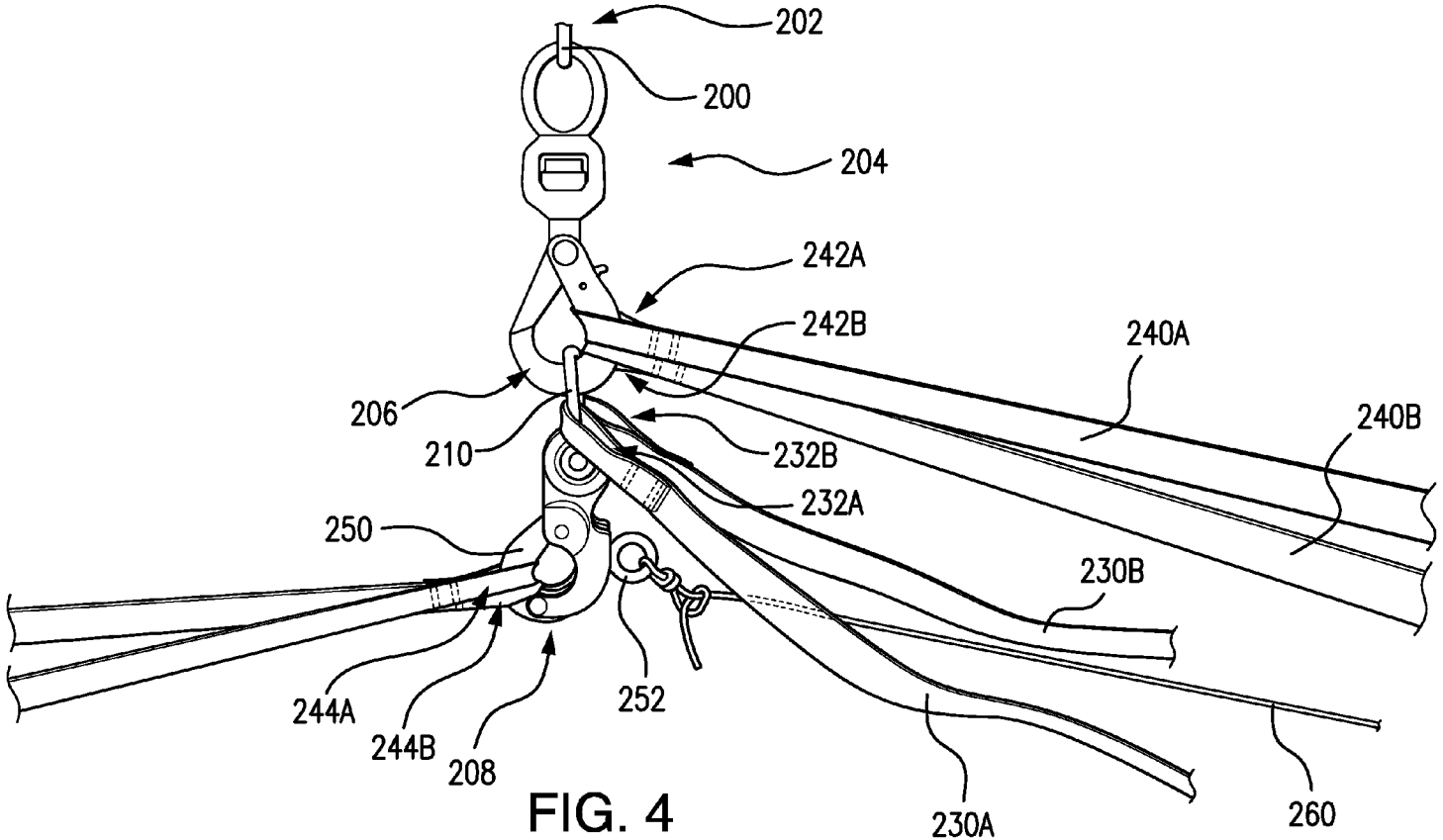
FIG. 4 is an isolated view of a lifting hook assembly and cooperating portions of straps for lifting a dumpster bag.

The exemplary releasable hook 208 (FIG. 4) includes a spring-loaded hook 250 pivotable between open and closed conditions and a release lever 252 for releasing the hook from the closed condition. A lanyard 260 is connected to the release lever allowing remote release.

Respective left and right terminal hooks 236A, 236B the dump strap(s) are connected to the respective associated left and right rear lower loop. This arrangement allows lifting by the lower rear of the bag to facilitate dumping.

The lifting strap(s) is (are) used for lifting. In this example, there are two separate lifting straps 240A, 240B. Other examples may involve more or fewer straps. With the arbitrarily defined direction, in the exemplary lifting, one strap 240A is defined as the left lifting strap and the other 240B is defined as the right lifting strap. Each of these exemplary straps (e.g., leather, fabric, rope, or cable) includes terminal loops (or shackles or carabiners or the like) for engaging the hooks. In this implementation, one end 242A, 242B of each strap is hooked to the main hook 206. Alternatively, if hooks or carabiners were used on the strap(s) it (they) could be hooked to the ring or shackle. Alternatively, a single strap could merely pass through the hook or ring or shackle. This effectively leaves protruding straps (or two protruding end portions of a single strap if a single strap were used).

Initially, as the attendant approaches a filled bag, the attendant may remove stays from the bag to avoid their damage in lifting and dumping. Portions of the lifting strap(s) and dumping strap(s) may be pre-secured to the hook assembly. In this example, these portions would be the dumping strap ends 232A, 232B and the lifting strap ends 242A, 242B. The releasable hook 208 may be open. The attendant locates the crane or other hoist with the hook assembly 204 suspended above the bag. The attendant then, in either order, engages the dumping strap(s) and lifting strap(s) to the bag. These respective left and right lifting straps or portions extending distally of the hook assembly may then be coupled to the bag loops (for example, coupled to the upper loops). More particularly, all the upper loops are coupled to such straps (in this example, the left strap 240A is passed back to the upper left rear loop to pass therethrough and the right strap 240B is passed back to the upper right rear loop to pass therethrough). The lifting straps then pass forward to the respective associated upper left front loop for the left strap and the upper right front loop for the right strap passing through such upper front loops and then passing back to the releasable hook. With the exemplary terminal loops 244A, 244B, the attendant may hook these loops over the open releasable hook and then close the releasable hook.

Figure 5:
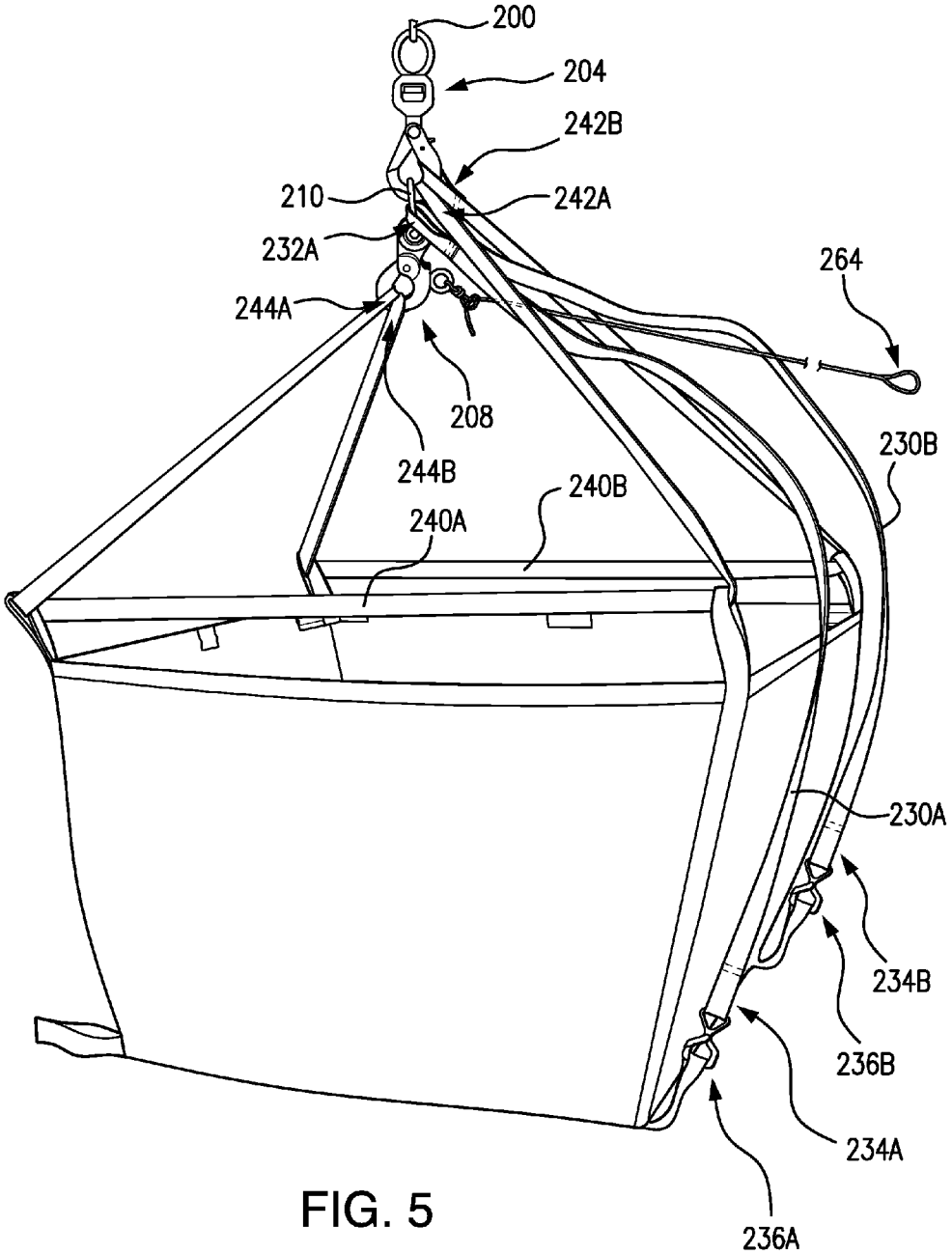
FIG. 5 is a view of the dumpster bag, hook assembly, and straps with the bag still supported atop ground or other support surface.

The attendant may secure the dumping strap(s) to the lower rear loops as previously discussed. The attendant may leave the lanyard extending free quite a distance away from the bag (e.g., so that an end portion 264 (FIG. 5) of the lanyard will remain on the ground throughout the process and will be easily accessed by the attendant).

Figure 6:
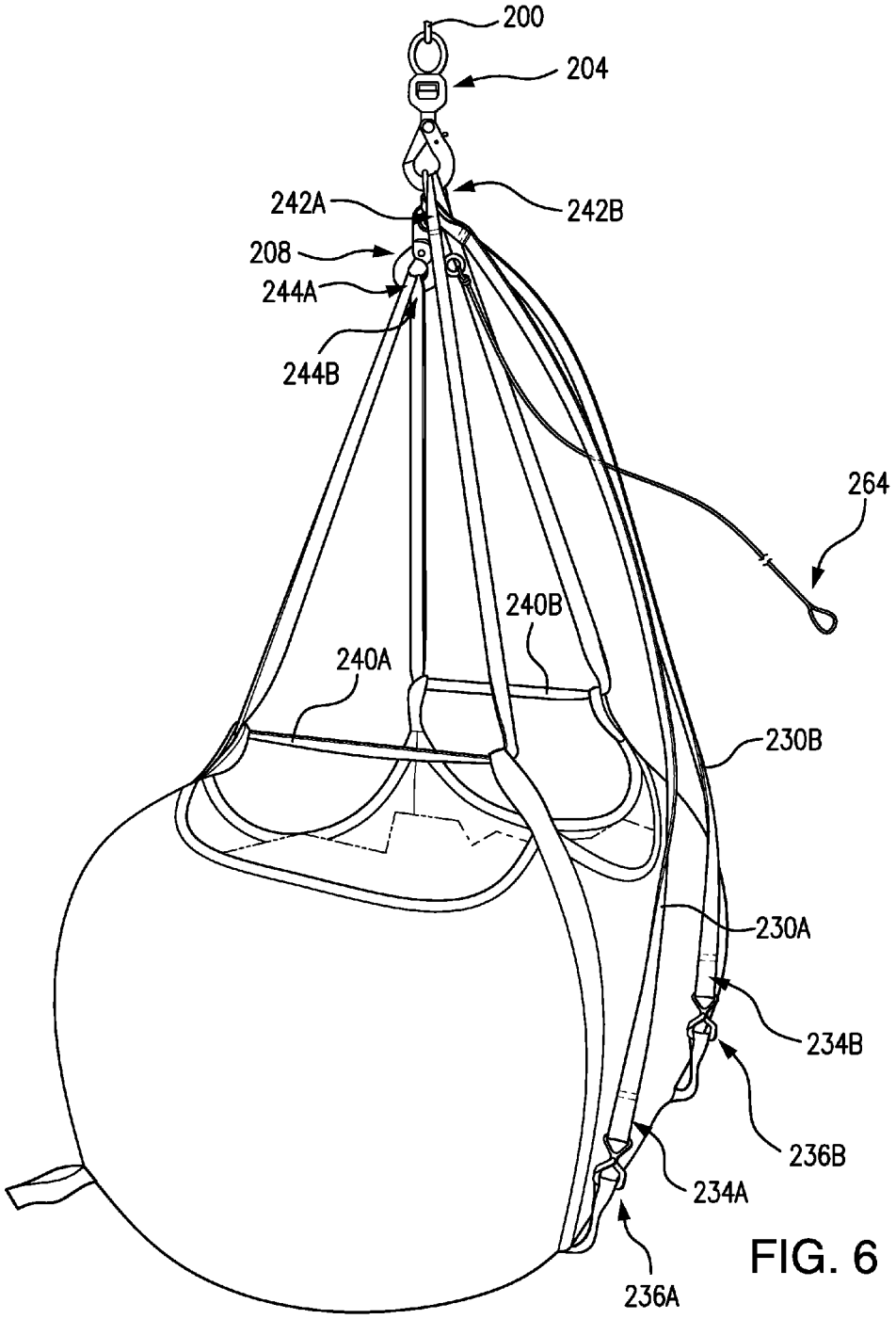
FIG. 6 is a view of the bag being lifted/carried by the hook assembly.

The attendant then uses the crane to lift the bag. The lifting strap(s) lift the bag by the upper loops on the bag (FIG. 6). There may be some residual lifting by the dumping strap depending on its length. The crane is used to lift the bag and move it to its desired dumping location by lowering the bag to at least partially take the load off the lifting straps. This may be at a remote location where the bag is to be dumped or may be, for example, in the bed of a truck or trailer into which the bag contents are to be dumped. An exemplary situation is with the bag supported atop the floor of such truck bed or trailer or atop any accumulation of refuse therein.

Figure 7:
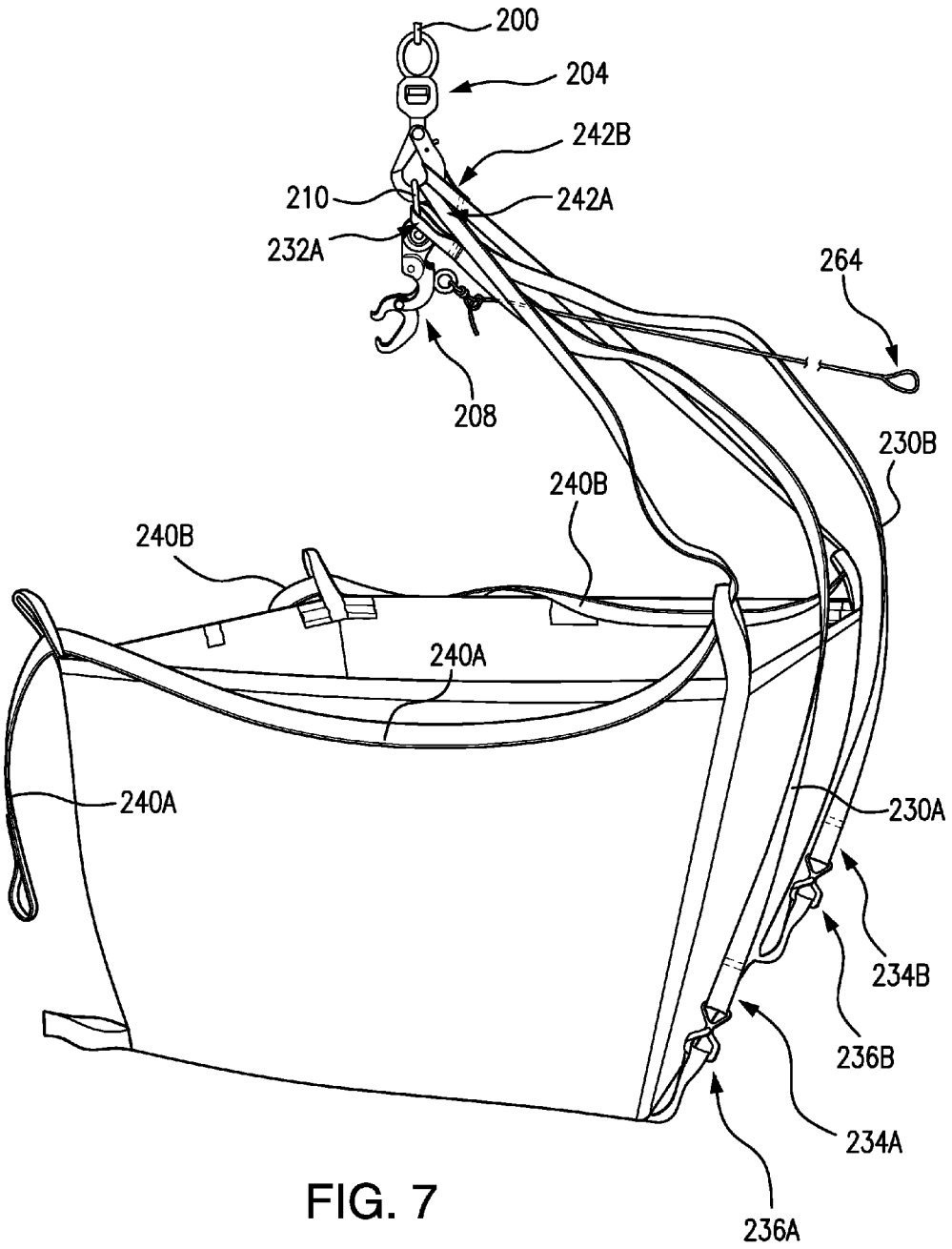
FIG. 7 is a view of the bag supported atop a support surface after strap release by the hook assembly.

The attendant then pulls the lanyard 260 to remotely release the releasable hook 208, freeing the associated ends 244A, 244B of the lifting straps (FIG. 7). The attendant then uses the crane to raise the bag. This may cause the lifting straps 240A, 240B to pull partially or fully through the associated upper loops allowing the front end of the bag to dangle while the dump straps lift the rear end of the bag via the rear loops (e.g., the lower rear loops).

Figure 8:
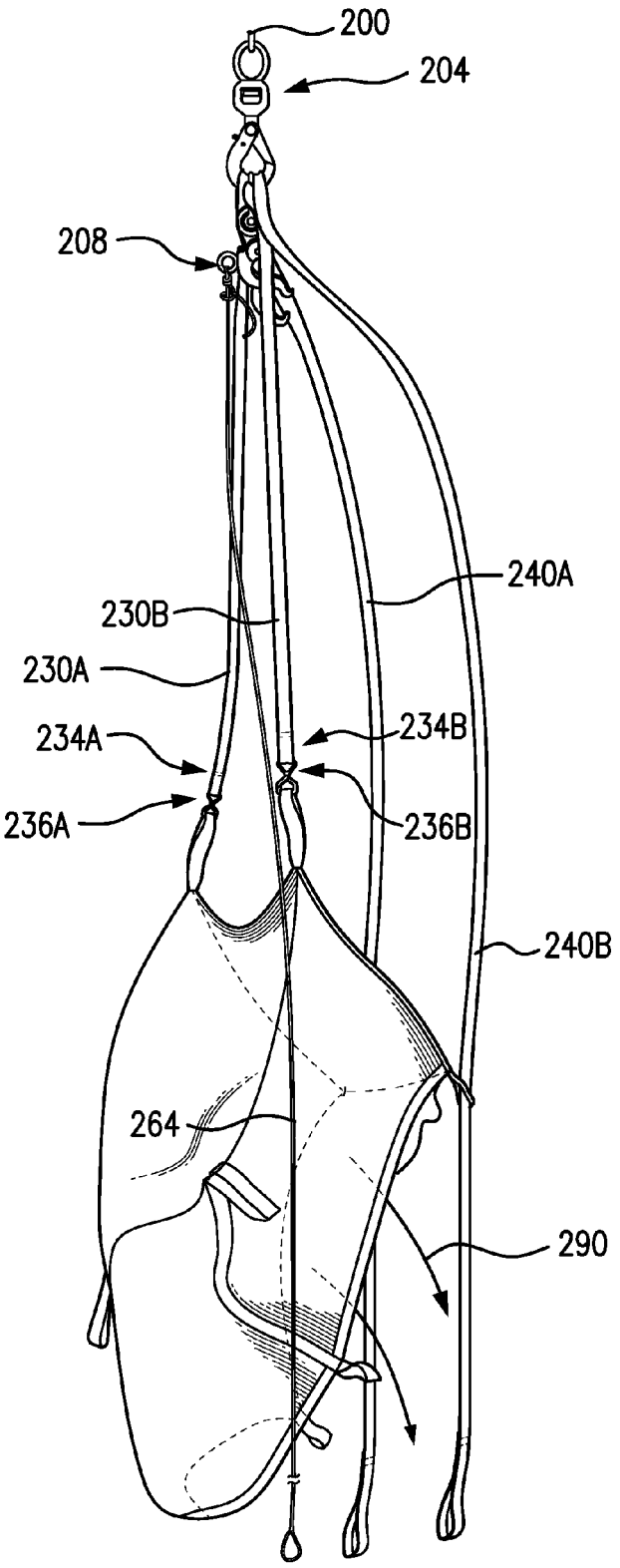
FIG. 8 is a view of the bag being dumped by relifting by the hook assembly after the release of FIG. 7.

Further lifting allows the bag to dump (FIG. 8) contents 290 over the dangling front wall and rim. The empty bag may be further lifted away from the dumped contents and removed. To the extent any stays had been left in the bag, those stays may be removed and the bag folded up for storage and ultimate reuse by reinstalling stays, refilling, etc.

And yet in alternate implementations, there may be an electrically-actuated releasable hook (e.g., with a remote switch and an electrical cord or wireless link replacing the lanyard).

Figure 9:
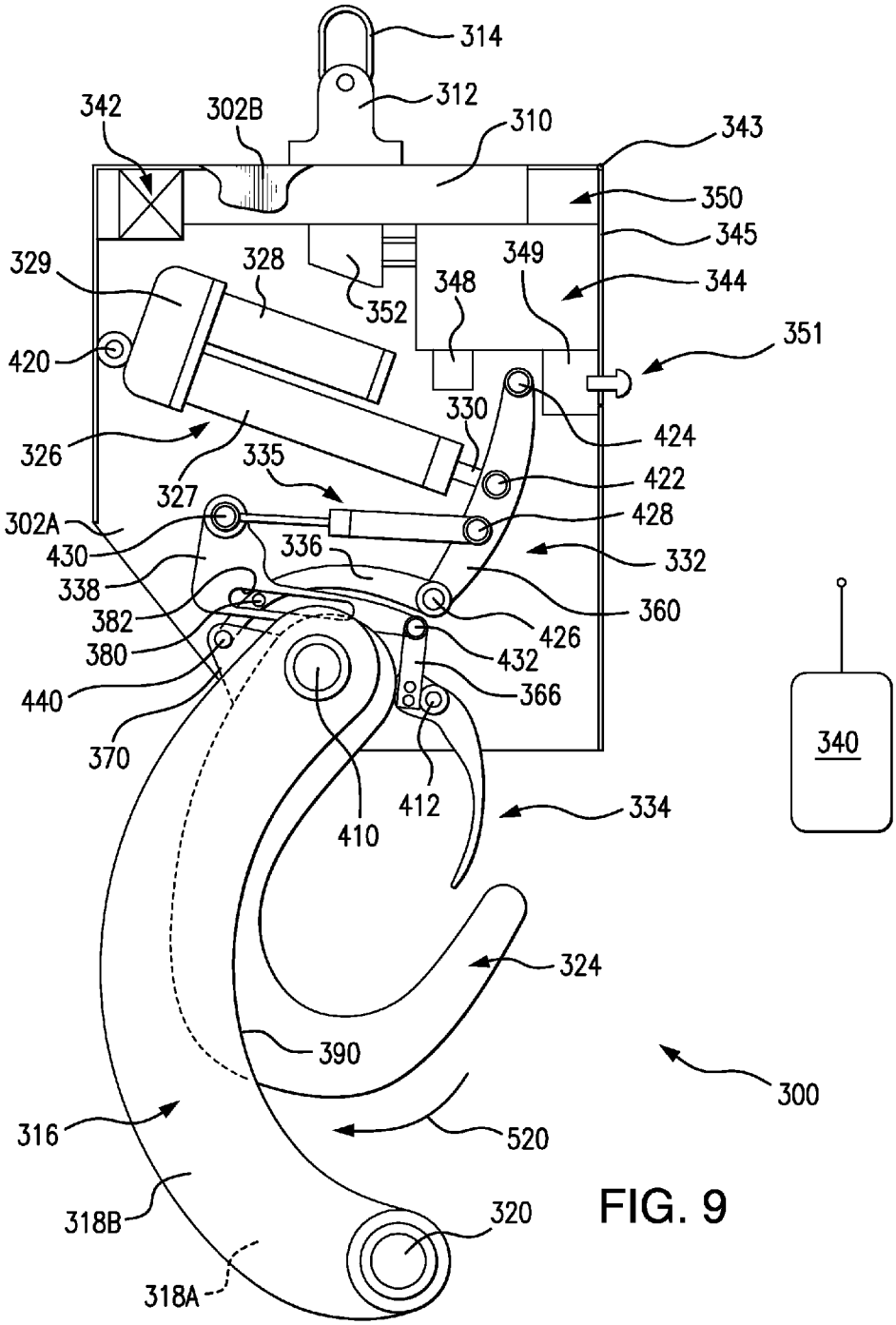
FIG. 9 is a partially schematic side view of a wireless remote controlled hook with side plate cutaway to reveal interior features.

FIG. 9 shows an exemplary wireless remote release hook device (assembly) 300. The device includes a pair of side plates 302A and 302B (cutaway) sandwiching components between (e.g., with various pivot axles (defining respective pivot axes) extending through holes in the plates). The plates (e.g., steel) may be secured to each other via spacers or a perimeter band (e.g., welded or via fasteners). Such spacers may include an exemplary aluminum block 310 to connect a lifting swivel 312 to the side plates (e.g., fastened by bolts (not shown)). The lifting swivel 312 is connected to exemplary ring 314 for connecting to the cable of the crane or other hoist.

FIG. 9 further includes a banana hook 316 (e.g., pivoting or non-pivoting shackle (e.g., with two side plates/arms 318A, 318B connected by a distal pin 320)) such as for attachment of straps for dumping and attachment of permanent (non-releasing) end of two lifting straps. One may secure the non-releasing strap(s) to the pin such strap end hooks or via wrapping over the pin through the arms 318A, 318B.

FIG. 9 further shows a release hook 324 (e.g., used for lifting straps that are threaded through four top loops on bag). An actuator 326 may be provided to release hook 324 from the illustrated closed/hooking condition by rotation about fixed pivot 410 in a direction 520 toward a retracted/unhooking/releasing condition (not shown) to release any straps held by the release hook. The exemplary actuator comprises a linear actuator 327 (e.g., a screw actuator) driven by a motor 328 (e.g., 12-volt worm drive with screw gearbox 329 with micro switches for reverse polarity to activate push and pull).

The actuator 327 has an extensible and retractable shaft 330. The exemplary actuator 326 is mounted via a fixed pivot 420 to the plates. The shaft 330 is coupled to a moving pivot 422 of a release mechanism/linkage 332.

FIG. 9 further shows a safety clasp 334 used to not let straps fall off the hook 324 until the remote control 340 is pressed. The clasp 334 may be compressed against bias of a device 335 (discussed below) to allow easy installation of straps to hook 324. The exemplary bias device 335 is a mechanical spring cylinder/piston providing bias force to the clasp to open and close and also to assist the release hook mechanism. The actuator's opening (retracting) of the hook 324 also causes the clasp 334 to open (retract) by means of sliding of an arm 336 and slide 338 with assistance from the device 335. To open and close the hook, the operator may use a hand held wireless remote control 340 with one or more buttons or the like.

FIG. 9 further shows housing 342 for two-position switch assembly electronics (e.g., a controller having a 2-position switching receiver which is similar to a garage door opener and has a small wire antenna protruding from it; an electric supply line is fed from the control box to motor 328).

FIG. 9 further shows a battery 344 in a battery compartment within the housing. The compartment is closed by a door 345. For supporting the battery and bounding the compartment, battery guide blocks 348, 349, and 350 are shown. Guide block 349 also serves as a housing for a clasp 351 of the door 346. Guide block 350 also serves as an attachment point (e.g., hinged 343 or otherwise interfitting for an opposite end of the door from the clasp). To electrically interface with the battery, FIG. 9 further shows a battery receiver connection 352 having positive and negative terminals (battery slides into to make connection and may be removed for charging). An exemplary clasp 351 is an aircraft race car type twist spring pin quick disconnect.

The linkage 332 comprises a link or pivot arm 360 upon which the actuator acts via the moving pivot 422 (fixed only relative to the shaft 330 and link 360 but moving relative to the hook body formed by the side plates). At a proximal end of the link 360, there is a fixed pivot 424. At a distal end of the link 360, there is a free pivot 426 coupling the link 360 to the proximal end of the arm 336. At an exemplary location intermediate the pivots 422 and 426, a free pivot 428 couples the link 360 to one end of the device 335. The opposite end of the device 335 is also coupled via a free pivot 430 to one end of the slide 338.

An opposite end of the slide 338 is coupled via a free pivot 432 to a lever portion 366 of the clasp 334 opposite the clasp tip about the clasp fixed pivot 412. The exemplary clasp 334 is an assembly having a main clasp (e.g., cast or machined), to which the lever portion 366 (e.g., a pair of side plates) is secured against rotation (e.g., welded or secured by fasteners).

To actuate the release hook, a distal end of the arm 336 is connected via a free pivot 440 to a lever portion 370 of the release hook 324. In the exemplary embodiment, extension of the actuator shaft 330 will rotate the link 360 counterclockwise (as viewed in FIG. 9) about the fixed pivot 424. This, in turn, will shift the free pivot 426 to the right as viewed, thereby pulling the free pivot 440 clockwise about the fixed pivot 410 so as to rotate the release hook 324 in the direction 520. Opposite motion by the actuator will reverse this.

FIG. 9 further shows a pin 380 in an intermediate location along the arm 336 received by a slot 382 in the slide. The slide assists in the clasp to open and close under pressure (the slot receives pin 380 to guide the slide and drive the clasp to a retracted condition when the hook is retracting)

The body of the device and pivot pins, hooks, clasps, arms and the like may be made out of steel with bronze bushings.

Use may be as in the aforementioned manual release hook with the pin 320 carrying non-releasing straps, and the hook 324 carrying the releasing straps.

In another exemplary use, four straps are attached to hook/shackle 316 via hook and bridle carrying the four straps. Two of those straps are hooked via hooks to any of the four straps on the bottom of the bag. The remaining two straps have loops on them which are then threaded through the top two loops each of the bag, back to the releasable hook 324 on the device.

When the operator wants to release the bag, a remote button is pushed, activating the ram 327. The ram 327 has a pivotal engagement to an intermediate location on lever 360. Lever 360 has a fixed proximal pivot. Lever 360 extends to a distal pivot with link 336. Arm 336 extends to a pivot at a location on the lever-like feature 370 (e.g., opposite the hook tip about the hook pivot). The lever 370 may be a plate welded to the exemplary hook casting to form a part of the hook. Extension of the actuator/ram 327 rotates the lever arm 360 about its fixed pivot (e.g., counter-clockwise, as viewed in FIG. 9). This does two things: via lever arm/link 336 and its pivotal connection to the hook, the hook is rotated to retract about its fixed pivot (e.g., clockwise, as viewed); and via the pin 380 sliding to one end of the slot in 338 further movement of the pin causes the clasp to retract (e.g., rotate clockwise in the illustration to allow space between the clasp end/tip and the hook tip for the straps to pass to be released). Retraction of the hook causes the adjacent concave surface 390 of the banana hook/shackle 316 to drive the straps to be released toward and over the hook tip.

After the release the operator then picks up and extends the crane boom which causes the two slings to unthread themselves through the top four loops of the bag, leaving only two remaining loops attached to the hook.

The weight of the bag and motion of the crane, coupled with the release of the loops, results in the bag being emptied.

The operator activates the remote control to reverse the motor causing the hooks and clasp to close again for future use.

Other remote release hooks may be used and hook and clasp features may be adopted from other hook devices. Other remote release hooks are available from The Caldwell Group, Inc., Rockford, Ill. and Securalift AS, Stavanger, Norway.

One or more embodiments of the present invention have been described. Nevertheless, it will be understood that various modifications may be made without departing from the spirit and scope of the invention. For example, when implemented in the redesign of an existing bag, details of the existing bag may influence details of any particular implementation. Accordingly, other embodiments are within the scope of the following claims.

What is claimed is:

1. A remote release hook unit for carrying and releasing a suspended load comprising:

a body;

a swivel for suspending the body;

a hook pivotally mounted to the body for articulation between first and second orientations;

an electric motor;

a battery for powering the electric motor;

a controller for receiving control signals and controlling the electric motor;

an actuator coupled to the electric motor to be driven by the electric motor;

a linkage coupling the actuator to the hook for driving the hook from the first orientation to the second orientation to release a suspended load from the hook;

a clasp drivable from a blocking condition to an unblocking condition by said linkage driving the hook from the first orientation to the second orientation; and a shackle held by the body.

2. A method for using the hook unit of claim 1, the method comprising:

driving the actuator by the electric motor so as to drive the hook via the linkage from the first orientation to the second orientation to release a suspended load from the hook.

3. The method of claim 2 wherein:

after the release, the load is still coupled to the shackle.

4. The method of claim 3 wherein:

the suspended load comprises waste in a bag; and the method is used to dump the waste from the bag.

5. The method of claim 2 wherein:

the driving of the hook causes the shackle to push the load off the hook to release the load.

6. The method of claim 5 wherein:

the suspended load comprises waste in a bag; and the method is used to dump the waste from the bag.

7. The method of claim 2 wherein:

the hook unit further comprises a clasp biased toward a first condition blocking the opening of the hook to prevent movement of a suspended load off the hook; and the driving of the hook causes the clasp to retract from the first condition toward an interior of the hook to permit said movement of a suspended load off the hook.

8. The method of claim 2 wherein:

the suspended load comprises waste in a bag; and the method is used to dump the waste from the bag.

9. The hook unit of claim 1 further comprising:

a shackle positioned to push the load off the hook to release the load as the hook is rotated from the first orientation to the second orientation.

10. A remote release hook unit for carrying and releasing a suspended load comprising:

a body;

a swivel for suspending the body;

a hook pivotally mounted to the body for articulation between first and second orientations;

an electric motor;

a battery for powering the electric motor;

a controller for receiving control signals and controlling the electric motor;

an actuator coupled to the electric motor to be driven by the electric motor, the actuator comprising an extensible and contractible member;

a linkage coupling the actuator to the hook for driving the hook from the first orientation to the second orientation to release a suspended load from the hook, the linkage including:

a first lever having:

a first pivot fixed relative to the body;

a second pivot coupled to the extensible and contractible member; and a third pivot coupled to the hook; and a shackle held by the body.

11. The hook unit of claim 10 wherein:

the linkage includes:

a link coupling the third pivot to the hook.

12. The hook unit of claim 11 wherein:

the link is coupled to the hook at a fourth pivot at a lever portion of the hook opposite from a J-end of the hook with the hook pivot intervening.

13. The hook unit of claim 11 wherein:

the link is coupled to the hook at a fourth pivot.

14. The hook unit of claim 10 further comprising a clasp:

biased toward a first condition blocking the opening of the hook to prevent movement of a suspended load off the hook; and retractable from the first condition toward an interior of the hook to permit said movement of a suspended load off the hook.

15. The hook unit of claim 10 further comprising a clasp drivable from a blocking condition to an unblocking condition by said linkage driving the hook from the first orientation to the second orientation.

16. A method for using a remote release hook, the remote release hook unit for carrying and releasing a suspended load and comprising:

a body;

a hook pivotally mounted to the body for articulation between first and second orientations;

an electric motor;

a battery for powering the electric motor;

a controller for receiving control signals and controlling the electric motor;

an actuator coupled to the electric motor to be driven by the electric motor;

a linkage coupling the actuator to the hook for driving the hook from the first orientation to the second orientation to release a suspended load from the hook; and a clasp biased toward a first condition blocking the opening of the hook to prevent movement of a suspended load off the hook, the method comprising:

driving the actuator by the electric motor so as to drive the hook via the linkage from the first orientation to the second orientation to release a suspended load from the hook, the driving of the hook causing the clasp to retract from the first condition toward an interior of the hook to permit said movement of a suspended load off the hook.

17. The method of claim 16 wherein:

the suspended load comprises waste in a bag; and the method is used to dump the waste from the bag.

18. The method of claim 17 wherein:

the driving of the hook causes a shackle to push the load off the hook to release the load.

19. The method of claim 16 wherein:

the driving of the hook causes a shackle to push the load off the hook to release the load.

20. The method of claim 19 wherein:

after the release, the load is still coupled to the shackle.

* * * * *